US006749234B2

(12) United States Patent
Bruce

(10) Patent No.: US 6,749,234 B2
(45) Date of Patent: Jun. 15, 2004

(54) VEHICLE DOOR LATCH DEVICE

(75) Inventor: Ian Bruce, Yamanashi-ken (JP)

(73) Assignee: Mitsui Kinzoku Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/252,113

(22) Filed: Sep. 23, 2002

(65) Prior Publication Data

US 2003/0222462 A1 Dec. 4, 2003

(30) Foreign Application Priority Data

Sep. 21, 2001 (JP) ..... 2001-289469

(51) Int. Cl.[7] ..... E05C 3/06

(52) U.S. Cl. ..... 292/216; 292/DIG. 56; 292/DIG. 73; 292/DIG. 57

(58) Field of Search ..... 292/216, DIG. 56, 292/DIG. 57, DIG. 73

(56) References Cited

U.S. PATENT DOCUMENTS 2,694,591 A * 11/1954 Anschuetz ..... 292/216
3,917,330 A * 11/1975 Quantz ..... 292/216
4,358,141 A * 11/1982 Hamada ..... 292/216
4,854,617 A * 8/1989 Hayakawa et al. ..... 292/216
5,141,270 A 8/1992 Shibata
5,520,426 A * 5/1996 Arabia et al. ..... 292/337
5,618,068 A 4/1997 Mitsui et al.
6,024,389 A * 2/2000 Arabia et al. ..... 292/216

FOREIGN PATENT DOCUMENTS

GB 2 226 849 A * 11/1990 ..... E05C/3/26

* cited by examiner

*Primary Examiner*—Gary Estremsky
(74) *Attorney, Agent, or Firm*—Browdy and Neimark

(57) ABSTRACT

A vehicle door latch device comprises a latch body, a latch provided in a recess of a latch body, and a ratchet provided in the recess. The latch body has a tongue part which comes into contact with an outer peripheral part of the latch, and a contact pin which comes into contact with the latch. The tongue part applies a first external force in an anti-rotational direction of the latch to the latch by contact with the outer peripheral part of the latch, and the contact pin applies a second external force in a axial direction of the latch shaft to the latch by contact with the latch. The tongue part comes into contact with the outer peripheral part when the latch is over-rotated exceeding a full-latched position.

6 Claims, 5 Drawing Sheets

VEHICLE DOOR LATCH DEVICE

FIELD OF THE INVENTION

The present invention relates to a vehicle door latch device and, more particularly, to a door latch device in which rattle of a latch to be engaged with a striker is prevented.

DESCRIPTION OF THE RELATED ART

As shown in FIG. 8, a conventional door latch device comprises a latch unit A attached to a vehicle door and a striker B fixed to a vehicle body (refer to U.S. Pat. No. 5,141,270). The closed state of a door is held in such a way where a ratchet C of the latch unit A is engaged with a latch D of the latch unit A to keep the engagement between the latch D and the striker B.

The latch D is rotatable to an over-rotated position from an unlatched position by the contact with the striker B. The situation from the unlatched position to the over-rotated position of the latch D is well shown in FIGS. 7 to 10 of U.S. Pat. No. 5,618,068. When the door is moved toward the closed position, the latch D is rotated clockwise in FIG. 8 of the accompanying drawings against the elasticity of a latch spring by the contact with the striker B, and when the latch D rotates up to a half-latched position, a pawl E of the ratchet C is engaged with a half-latch step F of the latch D (refer to FIG. 8 in U.S. Pat. No. 5,618,068). Furthermore, when the latch D reaches a full-latched position, the ratchet C is engaged with a full-latch step G of the latch D (refer to FIG. 9 in U.S. Pat. No. 5,618,068). The latch D is designed to be over-rotatable up to the mechanical rotational limit position exceeding the full-latched position so that the ratchet C can surely be engaged with the full-latch step G (refer to FIG. 10 in U.S. Pat. No. 5,618,068).

When the door is closed, various noises are generated from the door latch device. One of the causes of noise is vibration of the latch D. When the latch D is rotated about a latch shaft H, the latch D vibrates in an axial direction of the latch shaft H to generate rattle noise. If the clearance between the latch D and the latch shaft H is decreased as much as possible, the rattle noise of the latch D can be suppressed. However, a clearance in the neighborhood of zero inhibits a good rotation of the latch D. Furthermore, by providing, to the latch D, a resin projection which comes into sliding contact with a latch body J containing the latch D, the vibration of the latch D in the axial direction of the latch shaft H can also be suppressed. However, the frictional resistance because of the resin projection inhibits a good rotation of the latch D from the unlatched position to the full-latched position.

Furthermore, in many cases, a resin silencer for suppressing the shock noise is attached at the outer peripheral surface of the latch D. The silencer is provided at a part K on the side of the step G, and the silencer suppresses the shock noise generated when the pawl E of the ratchet C collides against the part K of the latch D. However, the silencer cannot reduce the shock noise when the latch D is restored from the over-rotated position (in almost all cases, equal to the mechanical rotational limit position) to the full-latched position and the step G of the latch D collides against the pawl E of the ratchet C. The reason is that the silencer cannot be provided to the step G. If the silencer is provided to the step G, the resin silencer makes the state of engagement between the latch D and the ratchet C unstable. Furthermore, the silencer which may be provided to the step G is extremely worn down by the strong pressure between the latch D and the ratchet C, and therefore, the effect of noise suppression does not last for a long time.

In order to reduce the shock noise when the step G of the latch D collides against the pawl E of the ratchet C, it is effective to weaken the force for over-rotating the latch D. The weakened force reduces the rebounding force applied to the latch D when the latch D is reversed at the mechanical rotational limit position, and consequently, the speed when the step G of the latch D collides against the pawl E is slowed down, and the shock noise is reduced. A rubber stopper L of the latch body J employed in U.S. Pat. No. 5,141,270 is capable of weakening the force for over-rotating the latch D by coming into contact with the striker B. However, the rubber stopper L does not come into contact with the latch D, and therefore, it has no substantial effect for suppressing the vibration of the latch D.

SUMMARY OF THE INVENTION

It is an object of the present invention to provide a vehicle door latch device in which the noise generated when the door is closed is suppressed.

DESCRIPTION OF THE PREFERRED EMBODIMENT

Figure 1:
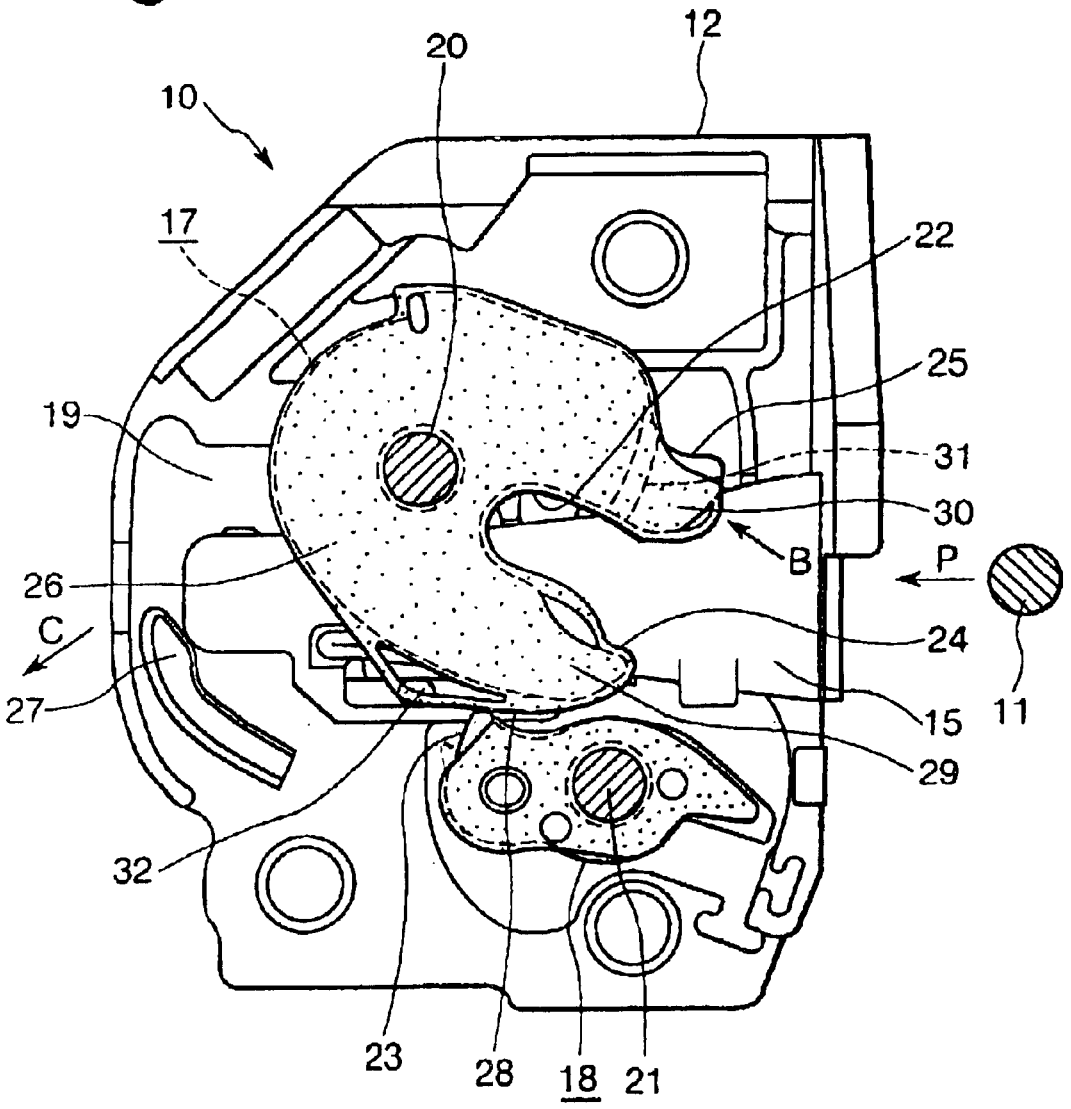
FIG. 1 is a front view of a door latch device according to the present invention in the unlatched state.

As shown in the appended FIGS. 1 to 7, the door latch device according to the present invention comprises a latch unit 10 to be attached to a vehicle door (not shown in the figure) and a striker 11 to be fixed to a vehicle body (not shown in the figure). The latch unit 10 has a synthetic resin latch body 12, a metal cover plate 13 (FIG. 5) to be fixed on the front side of the latch body 12, and a metal back plate 14 (FIG. 5) to be fixed on the back side of the latch body 12. The latch body 12 is provided with a striker groove 15 into which the striker 11 goes, and the cover plate 13 is provided with a notch 16 corresponding to the striker groove 15.

The latch unit 10 has a metal latch 17 to be engaged with the striker 11 when the door is closed and a metal ratchet 18 which keeps the engagement between the latch 17 and the striker 11. The latch 17 is rotatably contained in a recess 19 formed in the front side of the latch body 12 with a latch shaft 20, and the ratchet 18 is rotatably contained in the recess 19 with a ratchet shaft 21. The front surface of the recess 19 is substantially covered by the cover plate 13.

The latch 17 is urged in the counterclockwise direction in FIGS. 1 to 4 by the elasticity of a latch spring (not shown in the figure), and is held at an unlatched position shown in FIG. 1 when the door is open. The ratchet 18 is urged in the clockwise direction toward the latch 17 by the elasticity of a ratchet spring (not shown in the figure). When the door is moved toward the closed position, the striker 11 goes into the striker groove 15 along the arrow P to come into contact with a U-shaped groove 22 of the latch 17, and consequently, the latch 17 is rotated clockwise from the unlatched position against the elasticity of the latch spring, and when the latch 17 is rotated up to a half-latched position, a pawl 23 of the ratchet 18 becomes the state of being able to be engaged with a half-latch step 24 of the latch 17. Furthermore, when the latch 17 reaches a full-latched position (refer to FIG. 2), the pawl 23 of the ratchet 18 becomes the state of being able to be engaged with a full-latch step 25 of the latch 17. The latch 17 is designed to be able to be over-rotated up to a mechanical rotational limit position (FIG. 4) exceeding the full-latched position so that the pawl 23 of the ratchet 18 can-surely be engaged with the full-latch step 25. The pawl 23 of the ratchet 18 is, in fact, engaged with the full-latch step 25 of the latch 17 when the latch 17 is returned to the full-latched position after the over-rotation beyond the full-latched position. If the amount of over-rotation of the latch 17 is too small, in some cases, the pawl 23 of the ratchet 18 fails in being engaged with the full-latch step 25 since the rotation of the ratchet 18 by the elasticity of the ratchet spring is too late.

A resin silencer 26 is attached to the latch 17. The resin silencer 26 reduces the noise when the ratchet 18 collides against the latch 17, and the noise when the striker 11 collides against the latch 17. However, normally, the silencer 26 cannot be provided at least to the full-latch step 25.

Figure 2:
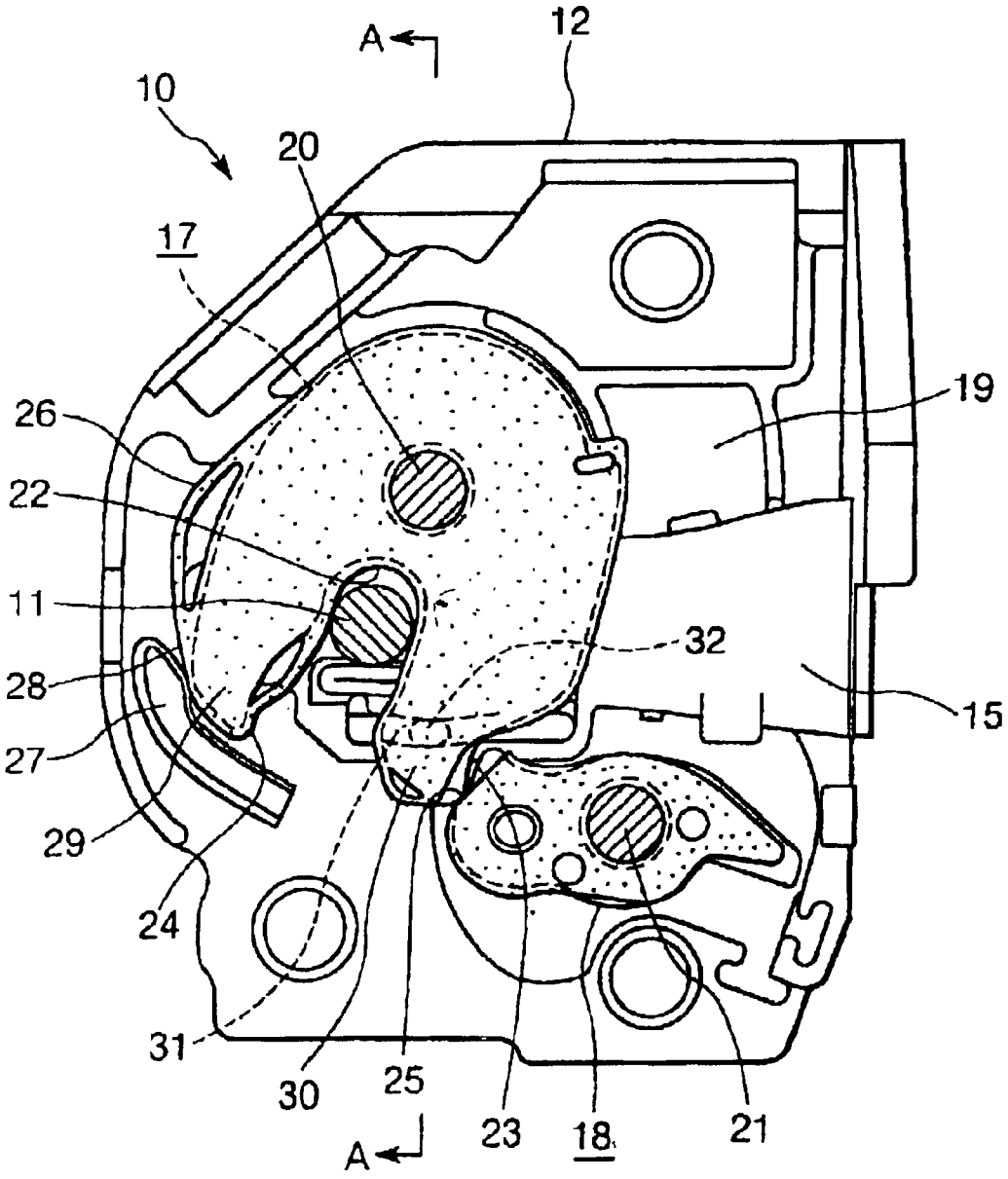
FIG. 2 is a front view of the door latch device in the full-latched state.

The latch body 12 integrally has a resin tongue part 27. The tongue part 27 has a height by which it can come into contact with an outer periphery part 28 of the latch 17. The tongue part 27 does not come into contact with the latch 17 when the latch 17 is positioned between the unlatched position (FIG. 1) and the full-latched position (FIG. 2). However, when the latch 17 is over-rotated exceeding the full-latched position, the tongue part 27 comes into contact with the outer peripheral part 28 of the latch 17 to weaken the external force for over-rotating the latch 17. It is preferable that the tip side of the tongue part 27 is elastically displaced in a direction of the arrow C by contact with the outer peripheral part 28. The outer peripheral part 28 is one of the parts of the latch 17 which are most separated from the latch shaft 20, and is positioned on the tip side of a door-closing side horn part 29 which defines a door-closing side wall of the U-shaped groove 22. The resin tongue part 27 can also suppress the vibration of the latch 17 since it directly comes into contact with the latch 17.

Figure 7:
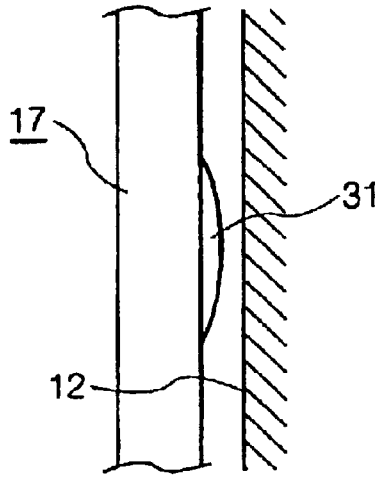
FIG. 7 is a cross sectional view showing the projection of the latch seen from the arrow B direction in FIG. 1.
Figure 6:
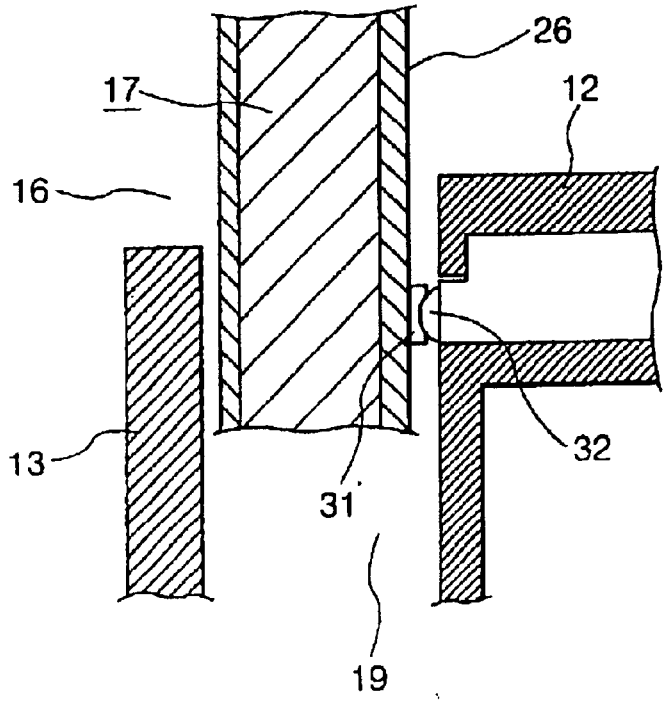
FIG. 6 is an enlarged cross sectional view showing a projection of the latch and a contact pin of a latch body.

The latch 17 has a door-opening side horn part 30 which defines a door-opening side wall of the U-shaped groove 22. A bulged part 31 projecting toward the latch body 12 is formed on the rear side of the horn part 30. It is preferable that the bulged part 31 is integrally formed with the silencer 26 as one-piece. The bulged part 31 is shaped like a circular arc as shown in FIG. 7, and the central part thereof is most projected backward. When the latch 17 is displaced into the full-latched position from the unlatched position as shown in FIG. 2, the bulged part 31 crosses the striker groove 15 and moves to the lower side of the latch body 12 on the basis of the striker groove 15.

To the latch body 12 below the striker groove 15, a contact pin 32 which can come into contact with the bulged part 31 is provided. The contact pin 32 is extending in parallel with the axial direction of the latch shaft 20, and is made of a resin. The contact pin 32 comes into contact with the central part of the bulged part 31 of the latch 17 when the latch 17 is positioned at the full-latched position (FIG. 2), and suppresses the vibration of the latch 17 in the axial direction of the latch shaft 20. Furthermore, the friction generated by the contact between the bulged part 31 and the contact pin 32 weakens the external force for over-rotating the latch 17.

Next, the action will be described.

Figure 3:
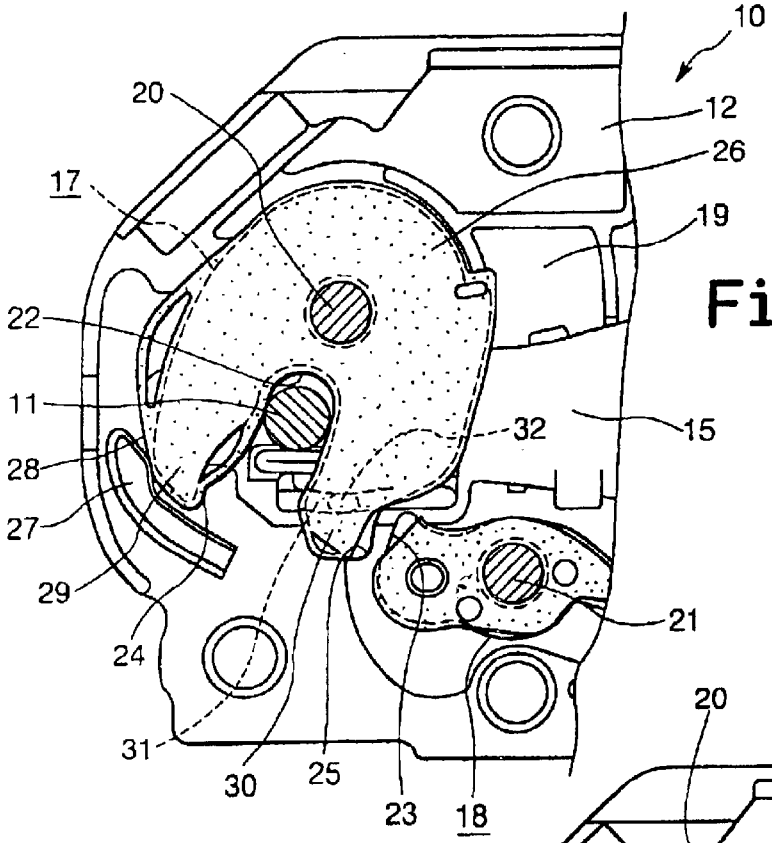
FIG. 3 is a front view of the door latch device in the state where the latch has been over-rotated slightly beyond the full-latched position.
Figure 4:
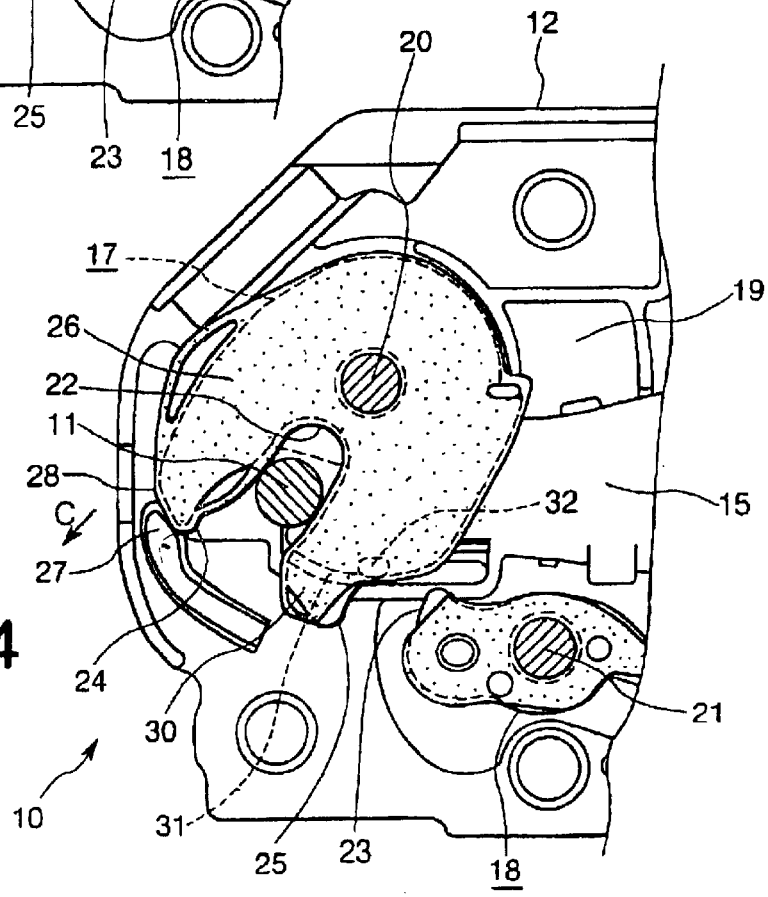
FIG. 4 is a front view of the door latch device in the state where the latch has been over-rotated up to the mechanical rotational limit position.
Figure 5:
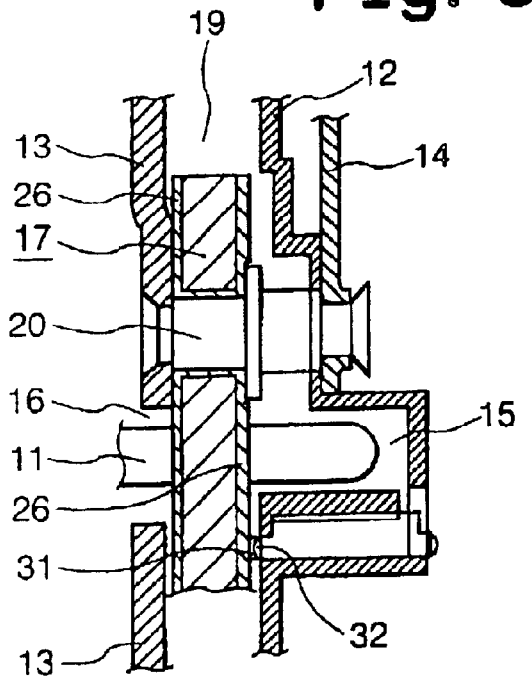
FIG. 5 is a cross sectional view of A—A in FIG. 2.

When the door is moved toward the closed position, the striker 11 relatively goes into the striker groove 15 along the arrow P to come into contact with the U-shaped groove 22 of the latch 17, and consequently, the latch 17 is rotated clockwise from the unlatched position against the elasticity of the latch spring, and it reaches the full-latched position through the half-latched position. Then, when the latch 17 is over-rotated beyond the full-latched position, the ratchet 18 is moved to a position where it can be engaged with the full-latch step 25 of the latch 17 by the elasticity of the ratchet spring as shown in FIG. 3. After that, the latch 17 is restored toward the full-latched position after the over-rotation up to the mechanical rotational limit position (or a position before that), and the metal full-latch step 25 of the latch 17 is engaged with the metal pawl 23 of the ratchet 18, and the door is held in the full-latched state.

In the above description, when the latch 17 comes to the full-latched position from the unlatched position by closing the door, the contact pin 32 of the latch body 12 comes into contact with the bulged part 31 of the latch 17 to apply a pressure in the axial direction of the latch shaft 20 to the latch 17. Therefore, the vibration of the latch 17 in the axial direction of the latch shaft 20 is efficiently suppressed, and the occurrence of noise is reduced. In the present invention, the contact between the contact pin 32 and the bulged part 31 is released when the latch 17 is over-rotated exceeding the full-latched position. However, depending on an experiment, the noise caused by the vibration of the latch 17 is surely reduced. One likely reason for this is that the vibration of the latch 17 in the axial direction of the latch shaft 20 is produced by the collision of the striker 11 against the latch 17 and if the vibration of the latch 17 is suppressed at the full-latched position, the vibration of the latch 17 after that is not substantially increased. Accordingly, it is important that a pressure in the axial direction of the latch shaft 20 is efficiently applied to the latch 17 at the full-latched position.

In addition, the contact between the bulged part 31 and the contact pin 32 works as a rotational resistance of the latch 17 which weakens the external force for over-rotating the latch 17, and the rebounding force applied to the latch 17 when the latch 17 is reversed at the mechanical rotational limit position is reduced. Therefore, the reversal rotation speed of the latch 17 at the collision of the metal full-latch step 25 against the metal pawl 23 of the ratchet 18 is slowed down, and the shock noise is reduced.

Furthermore, when the latch 17 has been over-rotated exceeding the full-latched position, the tongue part 27 formed on the latch body 12 comes into contact with the outer peripheral part 28 of the latch 17, and efficiently absorbs the external force for over-rotating the latch 17 so as to reduce the rebounding force applied to the latch 17 when the latch 17 is reversed at the mechanical rotational limit position is reduced. Therefore, the reversal rotation speed of the latch 17 at the collision of the metal full-latch step 25 against the metal pawl 23 of the ratchet 18 is slowed down, and the shock noise to be produced is reduced.

Figure 8:
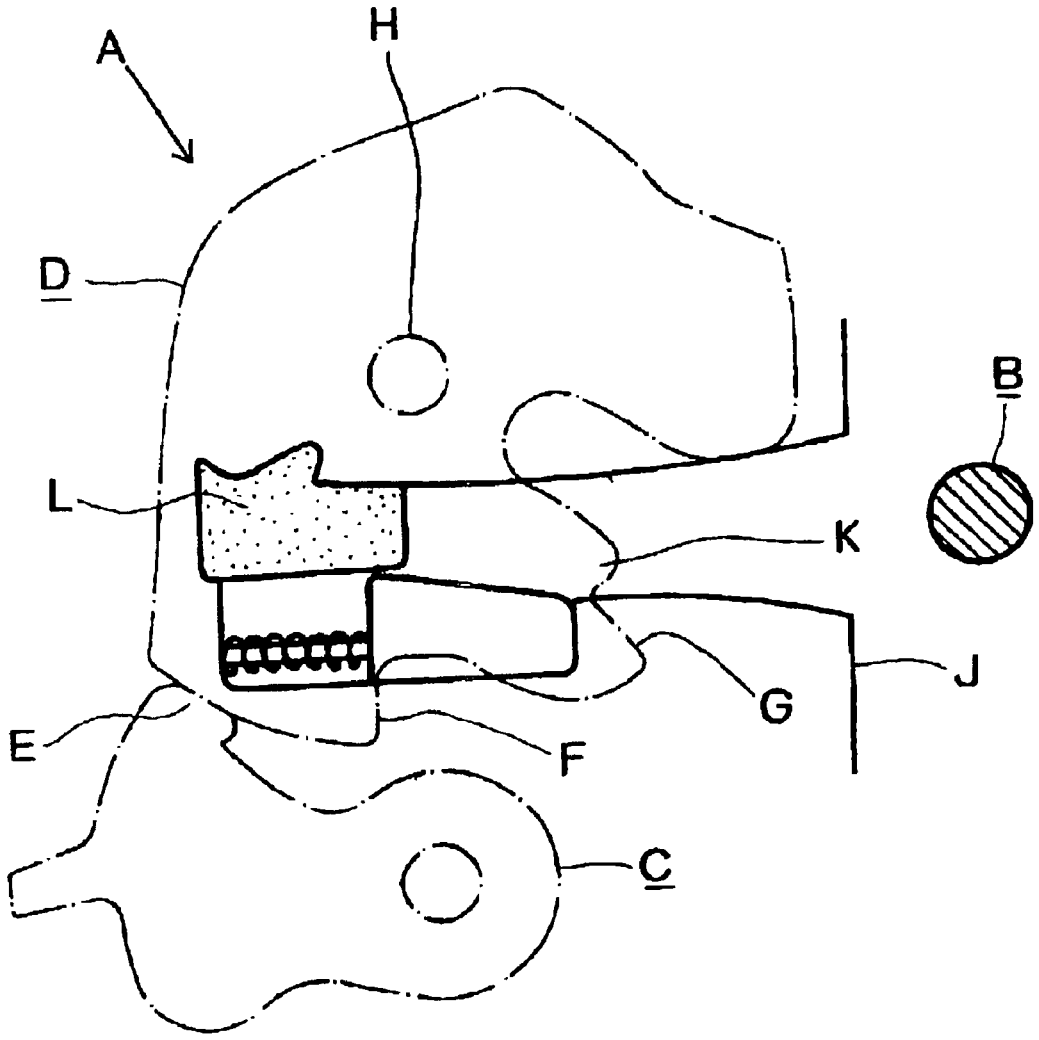
Fig. 8 (PRIOR ART)
FIG. 8 is a figure of a well-known example disclosed in U.S. Pat. No. 5,141,270.

The tongue part 27 comes into contact with the outer peripheral part 28 of the latch 17 differently from the rubber stopper L in FIG. 8. Accordingly, the tongue part 27 can also suppress the vibration of the latch 17 in the axial direction of the latch shaft 20.

The rotational resistance of the latch 17 based on the contact between the bulged part 31 and the contact pin 32, and the rotational resistance of the latch 17 based on the contact between the tongue part 27 and the outer peripheral part 28 are applied to the latch 17 when the latch 17 is substantially in the over-rotated state, and accordingly, a good rotation of the latch 17 from the unlatched position to the full-latched position is not inhibited.

Advantages

In the present invention, when the latch 17 is positioned at the full-latched position, a pressure in the axial direction of the latch shaft 20 is applied to the side of the latch 17 by the contact pin 32, and when the latch 17 is over-rotated exceeding the full-latched position, a pressure in the anti-rotational direction is applied to the latch 17 by the tongue part 27. Consequently, both the noise based on the vibration of the latch 17 and the noise based on the return speed of the latch 17 are reasonably reduced.

What is claimed is:

1. A vehicle door latch device comprising:

a latch body having a recess at a front side thereof;

a latch rotatably supported by a latch shaft in the recess and engageable with a striker fixed to a vehicle body;

a ratchet rotatably supported by a ratchet shaft in the recess for keeping an engagement between the latch and the striker by being engaged with the latch;

a tongue part provided to the latch body and arranged to come into contact with an outer peripheral part of the latch;

a contact pin provided to the latch body and arranged to come into contact with the latch;

said tongue part applying a first external force in an anti-rotational direction of the latch to the latch by coming into contact with the outer peripheral part of the latch; and said contact pin applying a second external force in a axial direction of the latch shaft to the latch by coming into contact with the latch.

2. The vehicle door latch device according to claim 1, wherein said tongue part comes into contact with the outer peripheral part when the latch is over-rotated exceeding a full-latched position.

3. The vehicle door latch device according to claim 2, wherein said outer peripheral part is provided at a door-closing side horn part which defines a door-closing side wall of a U-shaped groove of the latch to be engaged with the striker.

4. The vehicle door latch device according to claim 1, wherein said contact pin comes into contact with a side of the latch when the latch is positioned at a full-latched position.

5. The vehicle door latch device according to claim 4, wherein said tongue part comes into contact with the outer peripheral part when the latch is over-rotated exceeding the full-latched position.

6. The vehicle door larch device according to claim 4, wherein said contact pin comes into contact with a door-opening side horn part which defines a door-opening side wall of a U-shaped groove of the latch to be engaged with the striker.

* * * * *